United States Patent [19]

Ahern

[11] 4,256,298

[45] Mar. 17, 1981

[54] SELF-COMPENSATING REGISTRATION MECHANISM

[75] Inventor: Douglas K. Ahern, Penfield, N.Y.

[73] Assignee: Eastman Kodak Company, Rochester, N.Y.

[21] Appl. No.: 1,669

[22] Filed: Jan. 8, 1979

[51] Int. Cl.[3] ..... B65H 9/04

[52] U.S. Cl. ..... 271/245; 271/253

[58] Field of Search ..... 271/245, 246, 247, 253-255

[56] References Cited

U.S. PATENT DOCUMENTS

| | | | |
|---|---|---|---|
| 1,068,406 | 7/1913 | Bakke | 271/253 |
| 1,167,653 | 1/1916 | Nielsen | 271/253 |
| 2,065,880 | 12/1936 | Allsworth | 271/245 X |
| 3,888,478 | 6/1975 | Alderman | 271/8 R |
| 3,937,454 | 2/1976 | Colwill | 271/6 |
| 4,019,732 | 4/1977 | Hunt | 271/245 |
| 4,146,326 | 3/1979 | Taylor | 271/246 X |

OTHER PUBLICATIONS

IBM Technical Disclosure Bulletin, vol. 18, No. 10, p. 3199, Mar. 1976.

*Primary Examiner*—Richard A. Schacher
*Attorney, Agent, or Firm*—Lawrence P. Kessler

[57] ABSTRACT

A self-compensating registration mechanism for use with a sheet feeding apparatus for advancing sheets seriatim in a travel path subject to variation in dimension transverse to the direction of sheet travel in the path. The blocking means is movable relative to the path to a first position where it is engageable by an advanced sheet for registering such sheet, and a second position removed from the path so that the sheet can be advanced past the blocking means. The blocking means is urged toward its first position and movable to its second position against such urging by means including a coupling which compensates for variation in the dimension of the travel path so that the blocking means is movable to each of its positions for any dimension of the travel path.

8 Claims, 4 Drawing Figures

SELF-COMPENSATING REGISTRATION MECHANISM

BACKGROUND OF THE INVENTION

1. Field of the Invention

This invention relates in general to mechanisms for registering sheets in a travel path and more particularly to a self-compensating registration mechanism having a sheet registration gate which automatically adjusts to variations in the sheet travel path gap.

2. Description of the Prior Art

In certain types of high speed reproduction equipment, such as printing presses or electrophotographic copier/duplicators, information containing documents to be copied and/or pre-cut sheets of copy receiving material are fed seriatim in a travel path through the equipment in a predetermined operative cycle. In order to properly place an image of the document on the receiving material, the predetermined cycle typically requires registration of either the document or the receiving material (or both) at some point in their respective travel paths. One common mechanism for effecting such registration includes a retractable gate selectively blocking the travel path at a particular location; for example, see IBM *Technical Disclosure Bulletin,* Vol. 18, No. 10, p. 3199, or U.S. Pat. No. 3,937,454 (particularly FIG. 5).

Registration mechanisms having retractable gates provide satisfactory and reliable registration when used in conjunction with transport paths of fixed location relative to the mechanism. However, when the mechanism may vary in location relative to the transport path during operation, establishment and maintenance of gate adjustment has been difficult. Illustratively, when the travel path is defined by a gap between the registration mechanism and an opposed variably spaced guide, the gate may fail to completely span the gap between the mechanism and the guide and thus fail to block the path; or, the gate may be damaged or damage the guide if the travel of the gate is greater than the dimension of the gap.

SUMMARY OF THE INVENTION

This invention is directed to a selfcompensating registration mechanism for use with a sheet feeding apparatus for advancing sheets seriatim in a travel path subject to variations in dimension transverse to the direction of sheet travel in the path. The blocking means is movable relative to the path to a first position where it is engageable by an advanced sheet for registering such sheet, and a second position removed from the path so that the sheet can be advanced past the blocking means. The blocking means is urged toward its first position and movable to its second position against such urging by means including a coupling which compensates for variation in the dimension of the travel path so that the blocking means is movable to each of its positions for any dimension of the travel path. The coupling is a flexible member of a length sufficient to enable the blocking means to be urged to its first position for all variations in travel path dimension.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
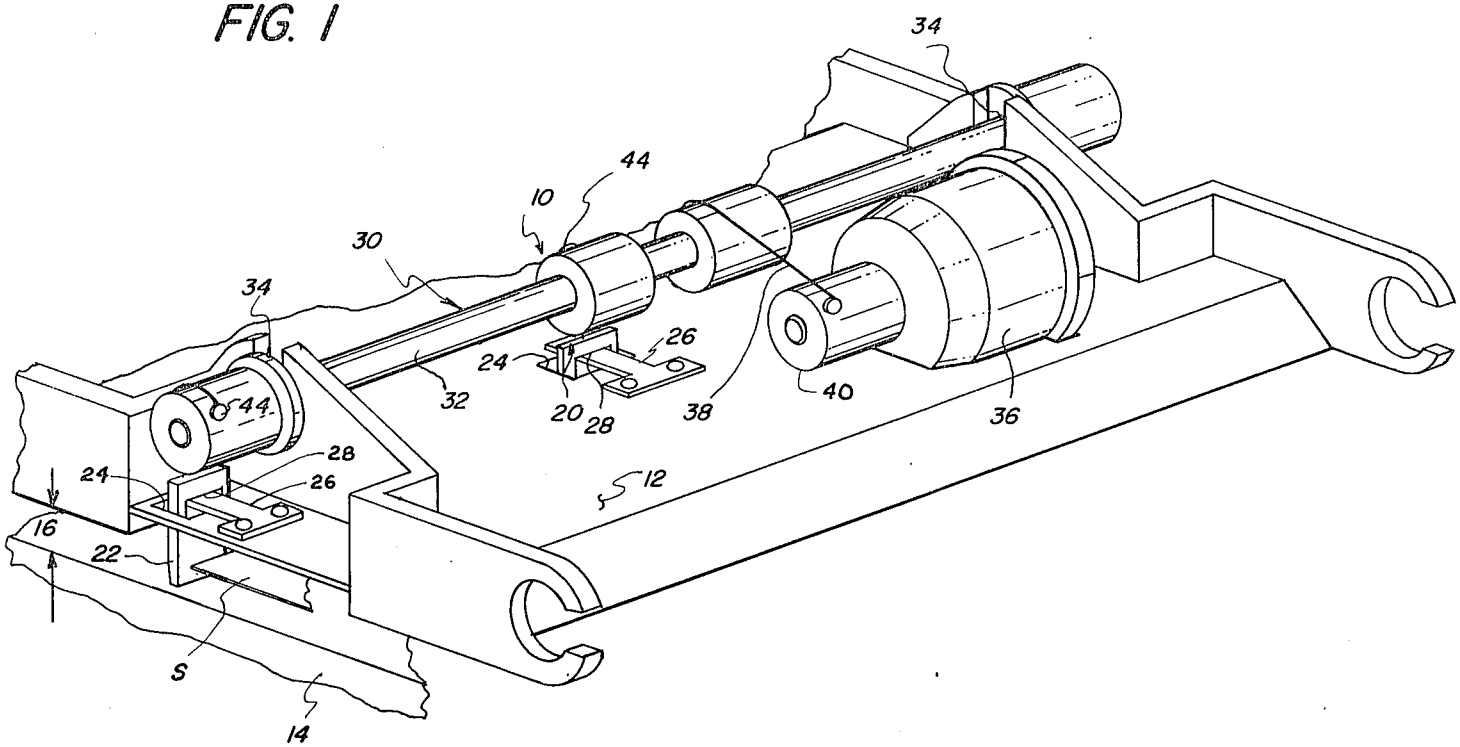
FIG. 1 is a view in perspective of the self-compensating registration mechanism according to this invention.
Figure 2:
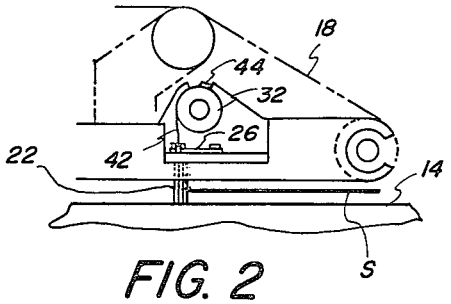
FIG. 2 is a side elevational view of a portion of the mechanism of FIG. 1 particularly showing one registration gate and its related structure.

The self-compensating registration mechanism of this invention is designated generally in the drawings by the numeral 10. The mechanism 10 is carried by a support plate 12 positioned adjacent to and spaced from a planar surface 14. The gap 16 (FIG. 1) between the plate 12 and the surface 14 defines a travel path for sheets fed seriatim along the path (e.g. sheet S). The sheets are fed in the travel path, for example, by a moving drive belt 18 (FIG. 2). The belt may feed the sheets by friction engagement with the sheets on the surface 14. Alternatively, the belt may be associated with a vacuum chamber to tack the sheets to the moving belt for feeding the sheets therewith. Thus the sheets may assume any vertical height within the gap 16. Furthermore, the position of the plate 12 above the surface 14 is adjustable within certain tolerance limits such that the vertical dimension of the gap 16 (transverse to the direction of travel of the sheets along the path) is variable. Such adjustment is desirable to establish the orientation of the plate to the surface for effective feeding of sheets in the travel path.

In order to register the fed sheets with respect to some downstream operation, or an operation performed at the registered location (e.g., exposure of an original document sheet for producing a copy thereof), the registration mechanism 10 includes blocking means 20 which selectively intercepts the travel path. Since the sheets to be registered may assume any vertical height within the gap 16 and the vertical dimension of the gap may vary, the blocking means must be capable of completely spanning the gap irrespective of its vertical dimension. Accordingly, the mechanism 10 selfcompensating to properly position the blocking means 20 for any gap dimension.

Figure 3:
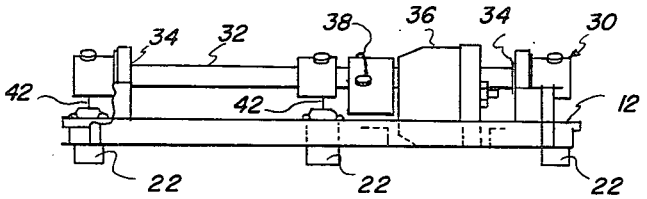
FIG. 3 is an end view of the structure of FIG. 1, with a portion broken away to facilitate viewing.

The structure of the registration mechanism 10 to accomplish self-compensation is as follows. The blocking means 20 comprises a plurality of hard plastic or metal gates 22 spaced laterally across the travel path (FIGS. 1, 3). The gates 22 extend respectively through a plurality of openings 24 in the plate 12. Resilient springs 26, fixed to the plate 12 adjacent to the openings 24, engage respective gates 22 such as by being received within receptacles 28 formed in the gates. The springs 26 constantly urge the gates 22 toward surface 14 and into their respective travel path intercepting positions. The constant of the springs is selected to urge the gates into engagement with the surface 14 with such force as to maintain the gates in engagement with surface but without damaging the surface or the gates. A retraction mechanism, designated generally in the drawings by numeral 30, retracts the gates 22 out of the travel path (against the urging of springs 26) to enable registered sheets to be fed further along the travel path.

Figure 4:
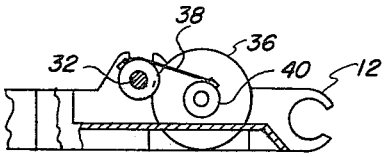
FIG. 4 is a side elevational view, partly in section, of the rotary solenoid and gate actuator shaft of the mechanism of FIG. 1.

The retraction mechanism 30 includes a shaft 32 supported for rotation in bearings 34 carried by upstanding marginal edges of the plate 12. The shaft 32 is operatively coupled to a rotary solenoid 36 to rotate the shaft about its longitudinal axis, through a given angle, upon actuation of the solenoid. Such operative coupling is preferably accomplished, for example, by a relatively high tensile strength flexible member 38, such as a thin wire or cord (FIG. 4). The ends of the flexible member 38 are fixed to and wrapped at least partially about the shaft 32 and an output shaft 40 of the solenoid 36. Thus, when the solenoid 36 is actuated, its output shaft 40 rotates (clockwise in FIG. 4) through a given angle to wrap the flexible member 38 about the output shaft. This causes the flexible member 38 to unwrap from the shaft 32 and impart a corresponding angle of rotation to the shaft.

The shaft 32 is, in turn, operatively coupled to the gates 22 by respective relatively high tensile strength flexible members 42, such as thin wire or cord. One end of each of the flexible members 42 is adjustably secured to the shaft, such as by clamping screws 44, while the other end is fixed to the respective gates. The adjustability of the lengths of the flexible members 42 enables the respective lengths to be individually set such that, for all vertical dimensions of the gap 16, a loop is established in each of the members when the solenoid 36 is deactivated and gates 22 are urged into contact with the surface 14 by springs 26. The establishment of the loops provides the self-compensation of the registration mechanism 10. That is, for any dimension of the gap less than the maximum gap dimension, when the gates engage the surface 14, the extent of the loops increases. Accordingly, the flexible members 42 do not inhibit the springs 26 from moving the gates into contact with the surface 14. The ability to individually adjust the flexible members 42 (for retraction of the respective gates) is desirable in that the gap may not be of a uniform dimension in the lateral direction across the travel path.

As the shaft 32 is rotated (clockwise in FIG. 1) through the angle of rotation by actuation of the rotary solenoid 36 to move the flexible member 38, the flexible members 42 wrap around the shaft and retract the gates 22 out of the travel path to release the registered sheet. The angle of rotation of the shaft 32 (dependent upon the relative diameters of the output shaft 40 and the shaft 32) is particularly selected to effect full retraction of the gates 22 for all dimensions of the gap 16. That is the angle is such that the wrap of the flexible members 42 about the shaft takes up the maximum extent of the loop (at the minimum gap dimension) and then fully retracts the gates. This insures that for any lesser extent of the loop (gap dimension larger than minimum) the gates are also fully retracted.

The invention has been described in detail with particular reference to a preferred embodiment thereof, but it will be understood that variations and modifications can be effected within the spirit and scope of the invention.

I claim:

1. Self-compensating registration mechanism for use with sheet feeding apparatus for advancing sheets seriatim along a travel path, such path being subject to variations in dimension transverse to the direction of sheet travel in such path, said registration mechanism comprising:

means for blocking such travel path, said blocking means being movable relative to such path to a first position wherein the blocking means is engageable by a sheet advanced along the path for registering such sheet, and a second position wherein a sheet can be advanced along such path past said blocking means;

means for urging said blocking means toward its first position; and means for moving said blocking means to its second position against the force of said urging means, said moving means including a retraction mechanism and self-compensating coupling means for connecting said retraction mechanism to said blocking means whereby variations in the dimension of such travel path are automatically compensated for so that said blocking means is movable to each of its positions for any such dimension of the path.

2. The invention of claim 1 wherein said retraction mechanism further includes a rotatable shaft, and means for rotating said shaft; and wherein said coupling means comprises a flexible member connected to said shaft and said blocking means so that rotation of said shaft by said rotating means is effective to move said blocking means from its first position to its second position, said flexible member being of a length sufficient for said urging means to move said blocking means to its first position for all variations in dimension of such travel path.

3. The invention of claim 2 wherein said rotating means comprises a solenoid movable to a first position for rotating said shaft to a position wherein said flexible member retracts said blocking means, and to a second position for rotating said shaft to a position wherein said flexible member frees said urging means for moving said blocking means to its first position.

4. The invention of claim 3 wherein said solenoid is of the rotary type and has an output shaft, and a flexible member operatively coupling said output shaft to said rotatable shaft.

5. The invention of claim 2 wherein said flexible member in a thin wire fixed at one end to said blocking means and adjustably attached to said shaft at the other end, said wire being of such length so as to free said urging means for moving said blocking means to its first position for all variations in dimensions of such travel path.

6. Self-compensating registration mechanism for use with sheet feeding apparatus for advancing sheets seriatim along a travel path, said sheet feeding apparatus including a support plate positioned adjacent to such travel path and subject to variations in spacing relative to such path transverse to the direction of sheet travel therein, and a plurality of openings defined by and extending through said support plate spaced laterally across such path, said registration mechanism comprising:

a plurality of movable registration gates selectively extensible through said plurality of openings respectively;

means for urging said plurality of registration gates through said respective openings toward a position wherein said gates are engageable by a sheet advanced along such path for registering such sheet; and means for selectively moving said plurality of registration gates to a position removed from such path wherein such registered sheet may be advanced along such path past said gates, said moving means including an actuator mounted on said support plate and a plurality of elongate flexible members having one end fixed to said plurality of registration gates respectively and the other end secured to said actuator such that the length of said flexible members is adjustable, such adjustable length being selected to compensate for variation in spacing of said support plate to such travel path, whereby said plurality of gates are movable, for any relative spacing between said support plate and travel path, into their path intercepting positions by said urging means and to their removed position upon actuation of said actuator.

7. The invention of claim 6 wherein said urging means comprises a plurality of resilient springs mounted on said support plate and engaging said plurality of registration gates respectively.

8. The invention of claim 6 wherein said actuator includes a shaft rotatably mounted on said support plate, said flexible members being adjustably secured to said shaft, and means operatively coupled to said shaft for rotating said shaft through an angle sufficient to move said plurality of gates out of such travel path.

* * * * *